US006938632B2

(12) United States Patent
Coursey

(10) Patent No.: US 6,938,632 B2
(45) Date of Patent: Sep. 6, 2005

(54) HUNTER CONCEALMENT SYSTEM

(76) Inventor: Bradley W. Coursey, 405 Shultz La., Livermore, KY (US) 42352

( * ) Notice: Subject to any disclaimer, the term of this patent is extended or adjusted under 35 U.S.C. 154(b) by 0 days.

(21) Appl. No.: 10/290,423

(22) Filed: Nov. 6, 2002

(65) Prior Publication Data

US 2004/0084076 A1 May 6, 2004

(51) Int. Cl.[7] ..... E04H 15/54
(52) U.S. Cl. ..... 135/115; 135/901; 135/903
(58) Field of Search ..... 135/900, 901, 135/902, 115, 156, 95, 96, 903; 160/31, 24, 26; 43/1

(56) References Cited

U.S. PATENT DOCUMENTS

| | | | | | |
|---|---|---|---|---|---|
| 2,192,671 | A | * | 3/1940 | Boughton | 248/253 |
| 2,511,452 | A | * | 6/1950 | Anderson et al. | 135/157 |
| 2,666,441 | A | * | 1/1954 | Powers | 135/117 |
| 3,323,530 | A | | 6/1967 | Smith | 135/1 |
| 3,799,608 | A | | 3/1974 | Smutny et al. | 297/184 |
| 3,848,352 | A | | 11/1974 | Sayles | 43/1 |
| 3,902,264 | A | | 9/1975 | Radig | 43/1 |
| 4,581,837 | A | | 4/1986 | Powlus | 43/1 |
| 4,716,919 | A | * | 1/1988 | Griffin | 135/133 |
| 4,751,936 | A | | 6/1988 | Zibble et al. | 135/117 |
| 5,174,073 | A | * | 12/1992 | Sabo | 52/3 |
| 5,579,820 | A | | 12/1996 | LePage et al. | 160/268.1 |
| 5,592,960 | A | | 1/1997 | Williams | 135/87 |
| 5,647,159 | A | * | 7/1997 | Latschaw | 43/1 |
| 5,903,997 | A | | 5/1999 | Jacob | 43/1 |
| 6,021,794 | A | * | 2/2000 | Guerra | 135/95 |
| 6,408,922 | B2 | * | 6/2002 | Desrochers | 160/24 |
| 2003/0019173 | A1 | * | 1/2003 | Martin | 52/209 |

* cited by examiner

*Primary Examiner*—Korie Chan
(74) *Attorney, Agent, or Firm*—Harness, Dickey & Pierce, P.L.C.

(57) ABSTRACT

A hunter concealment system for effectively concealing a hunter without physically interfering with the hunter. The hunter concealment system includes a frame structure having a plurality of openings, a first rail and a second rail on opposing sides of each opening, a recoil unit attached to an end of each opening, a camouflage sheet retained within the recoil unit, a first connector attached to a handle member of the camouflage sheet, and a second connector attached to the frame for catchably receiving the first connector. The hunter concealment system is positioned over a goose pit or other location for the purpose of selectively concealing the hunter. When the hunter desires, they simply engage the handle member thereby releasing the first connector which allows the recoil unit to automatically draw the camouflage sheet into the recoil unit.

5 Claims, 6 Drawing Sheets

HUNTER CONCEALMENT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to hunter camouflage devices and more specifically it relates to a hunter concealment system for effectively concealing a hunter without physically interfering with the hunter.

2. Description of the Related Art

Hunter camouflage devices have been in use for years. Conventional camouflage devices have various forms and structures such as but not limited clothing, sheet material, partial enclosures and full enclosures.

The main problem with conventional camouflage devices is that they require a significant amount of effort to remove before attempting to shoot a gun. Another problem with conventional camouflage devices is that they sometimes interfere with the hunter while the hunter attempts to fire the gun. Another problem with conventional camouflage devices is that they often times do not automatically open for the hunter to be freely exposed.

Examples of patented devices which may be related to the present invention include U.S. Pat. No. 5,579,820 to LePage et al.; U.S. Pat. No. 3,323,530 to Smith; U.S. Pat. No. 5,903,997 to Jacob; U.S. Pat. No. 5,647,159 to Latschaw; U.S. Pat. No. 5,592,960 to Williams; U.S. Pat. No. 3,799,608 to Smutny et al.; U.S. Pat. No. 4,751,936 to Zibble et al.; U.S. Pat. No. 3,902,264 to Radig; U.S. Pat. No. 3,848,352 to Sayles; U.S. Pat. No. 4,581,837 to Powlus.

While these devices may be suitable for the particular purpose to which they address, they are not as suitable for effectively concealing a hunter without physically interfering with the hunter. Conventional camouflage devices do not provide an effective system for camouflaging a hunter and allowing the hunter to easily fire a gun.

In these respects, the hunter concealment system according to the present invention substantially departs from the conventional concepts and designs of the prior art, and in so doing provides an apparatus primarily developed for the purpose of effectively concealing a hunter without physically interfering with the hunter.

BRIEF SUMMARY OF THE INVENTION

In view of the foregoing disadvantages inherent in the known types of camouflage devices now present in the prior art, the present invention provides a new hunter concealment system construction wherein the same can be utilized for effectively concealing a hunter without physically interfering with the hunter.

The general purpose of the present invention, which will be described subsequently in greater detail, is to provide a new hunter concealment system that has many of the advantages of the camouflage devices mentioned heretofore and many novel features that result in a new hunter concealment system which is not anticipated, rendered obvious, suggested, or even implied by any of the prior art camouflage devices, either alone or in any combination thereof.

To attain this, the present invention generally comprises a frame structure having a plurality of openings, a first rail and a second rail on opposing sides of each opening, a recoil unit attached to an end of each opening, a camouflage sheet retained within the recoil unit, a first connector attached to a handle member of the camouflage sheet, and a second connector attached to the frame for catchably receiving the first connector. The hunter concealment system is positioned over a goose pit or other location for the purpose of selectively concealing the hunter. When the hunter desires, they simply engage the handle member thereby releasing the first connector which allows the recoil unit to automatically draw the camouflage sheet into the recoil unit.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a hunter concealment system that will overcome the shortcomings of the prior art devices.

A second object is to provide a hunter concealment system for effectively concealing a hunter without physically interfering with the hunter.

Another object is to provide a hunter concealment system that may be utilized in various applications such as but not limited to goose pits, duck blinds and the like.

A further object is to provide a hunter concealment system that may be utilized in a horizontal, vertical or angled position.

An additional object is to provide a hunter concealment system that is low profile.

A further object is to provide a hunter concealment system that does not require significant effort to engage or disengage.

Another object is to provide a hunter concealment system that is lightweight and easy to transport.

A further object is to provide a hunter concealment system that allows for the interchanging of camouflage patterns.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
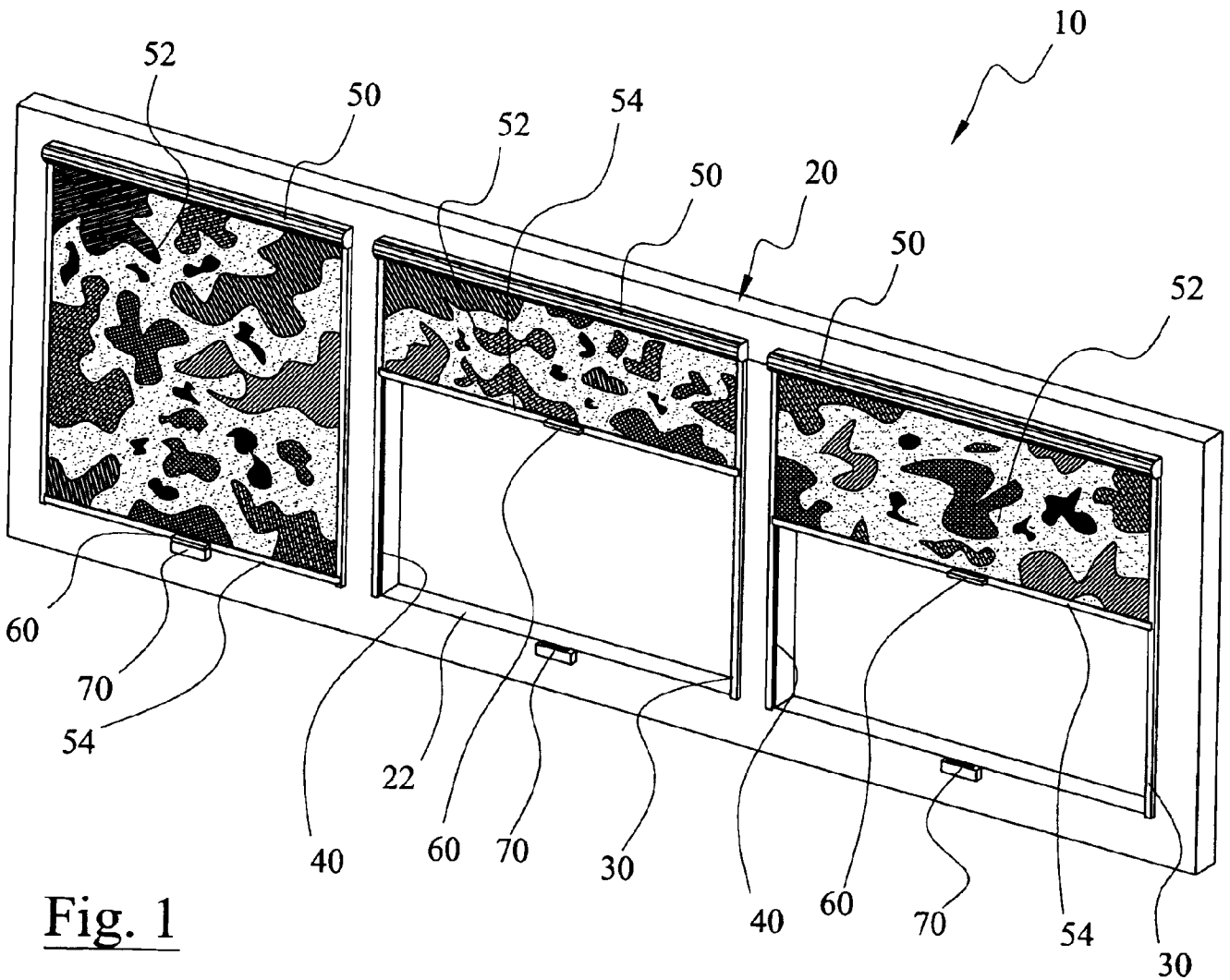
FIG. 1 is an upper perspective view of the present invention.

Turning now descriptively to the drawings, in which similar reference characters denote similar elements throughout the several views, FIGS. 1 through 6 illustrate a hunter concealment system 10, which comprises a frame structure 20 having at least one opening 22, a first rail 30 and a second rail 40 on opposing sides of each opening, a recoil unit 50 attached to an end of each opening, a camouflage sheet 52 retained within the recoil unit 50, a first connector 60 attached to a handle member 54 of the camouflage sheet 52, and a second connector 70 attached to the frame for catchably receiving the first connector 60. The hunter concealment system is positioned over a goose pit 12 or other location for the purpose of selectively concealing the hunter. When the hunter desires, they simply engage the handle member 54 thereby releasing the first connector 60 which allows the recoil unit 50 to automatically draw the camouflage sheet 52 into the recoil unit 50.

FIG. 1 best illustrates the frame structure 20 and the plurality of openings 22 within the frame structure 20. The frame structure 20 is preferably comprised of an elongate rectangular structure, however various other structures may be utilized to construct the frame structure 20. The frame structure 20 may be comprised of various well known materials such as but not limited to wood, metal, plastic and composite materials.

Figure 6:
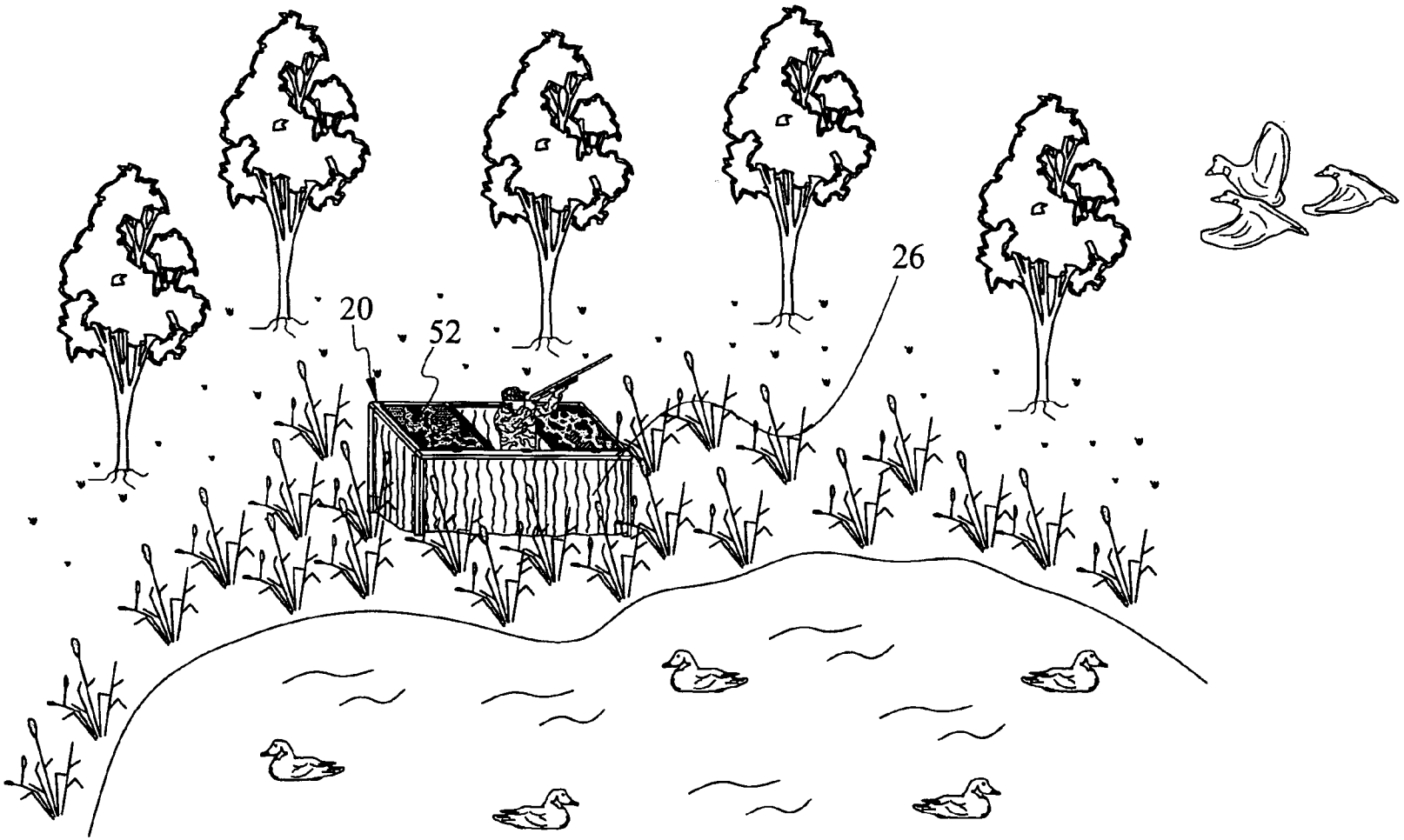
FIG. 6 is an upper perspective view of the alternative embodiment of the present invention with a panel member opened.

Each opening 22 within the frame structure 20 is preferably square or rectangular as shown in FIG. 1 of the drawings. However, the openings 22 may have various other well known shapes and sizes as desired. The size of the openings 22 is preferably sufficient for allowing a hunter to extend completely through the opening 22 when the camouflage sheet 52 is retracted as shown in FIG. 6 of the drawings.

Figure 2:
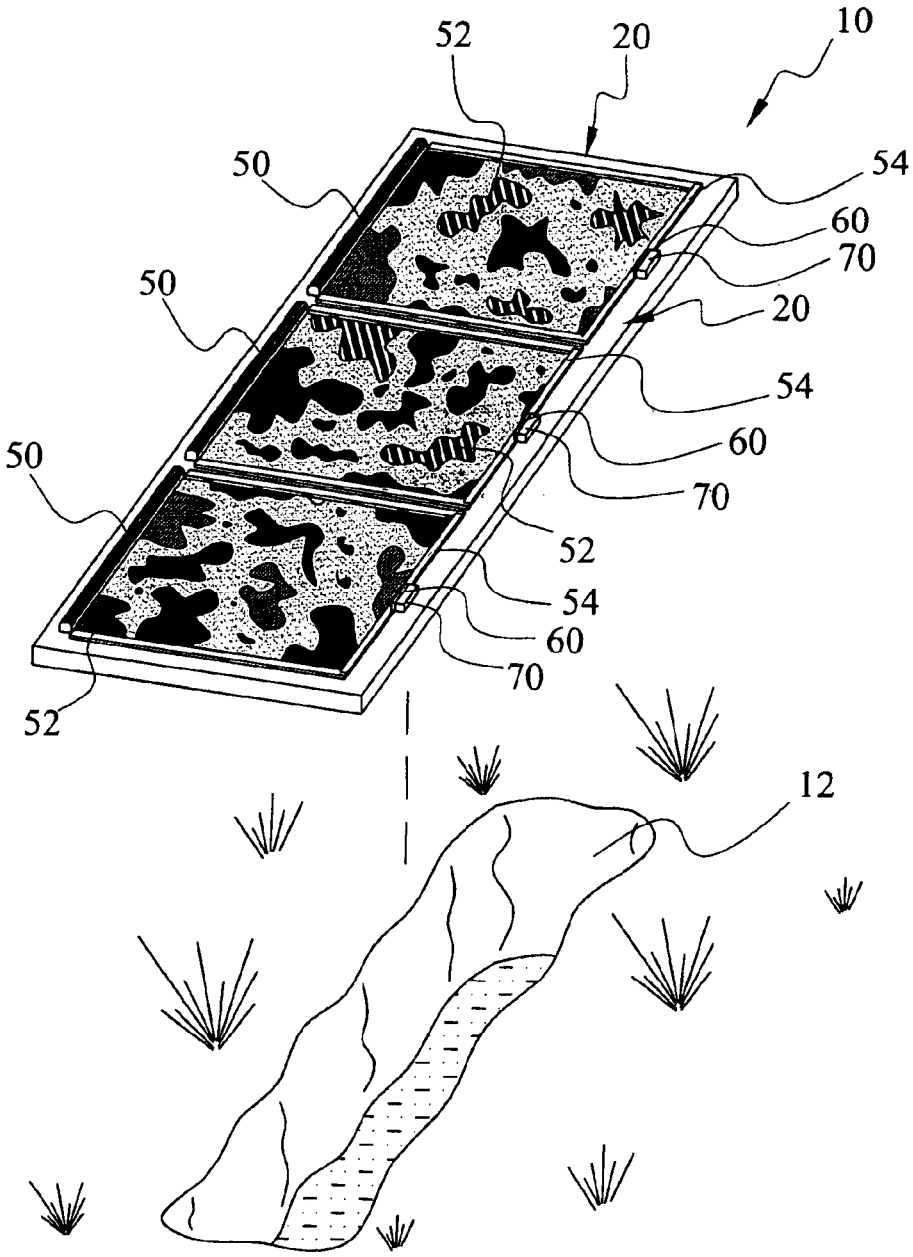
FIG. 2 is an exploded upper perspective view of the present invention with respect to a goose pit.
Figure 3:
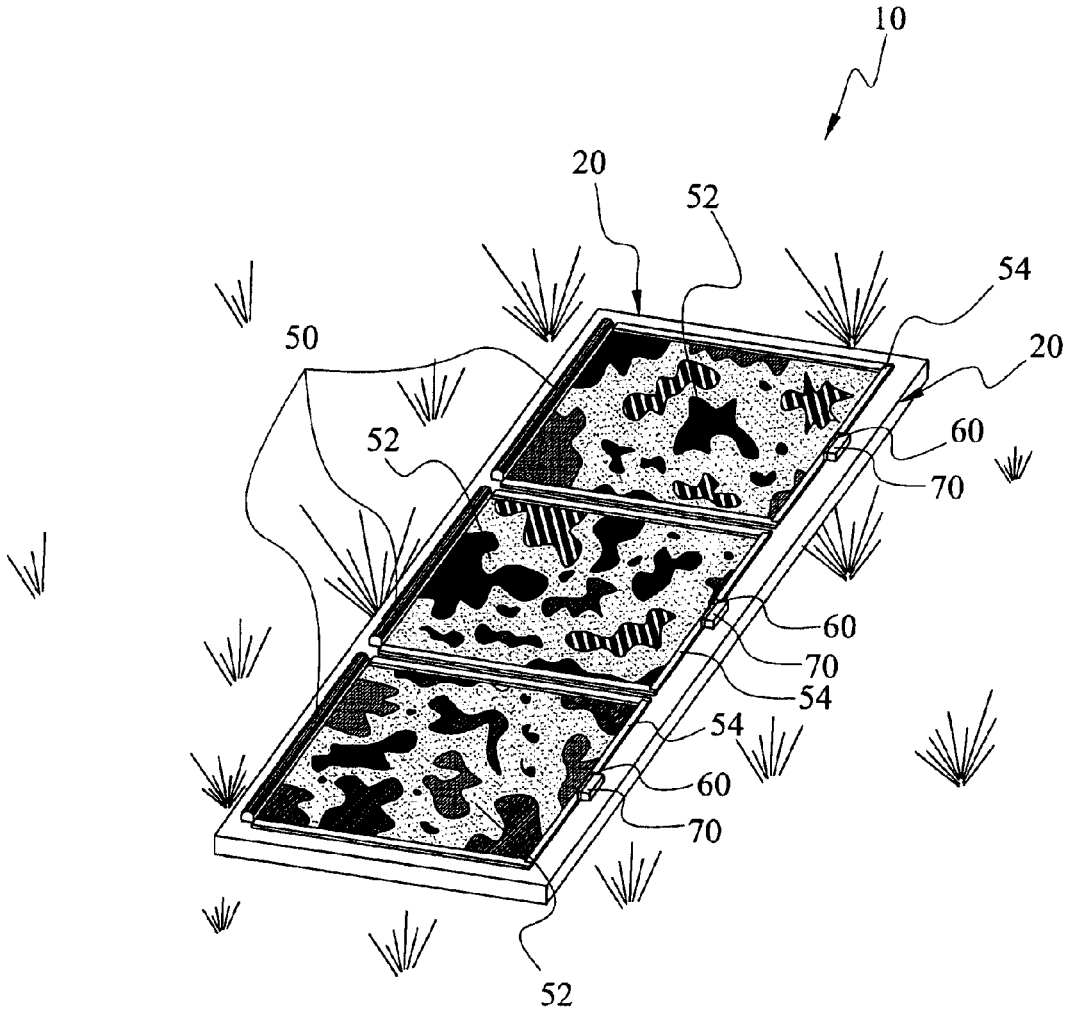
FIG. 3 is an upper perspective view of the present invention positioned upon a goose pit.
Figure 4:
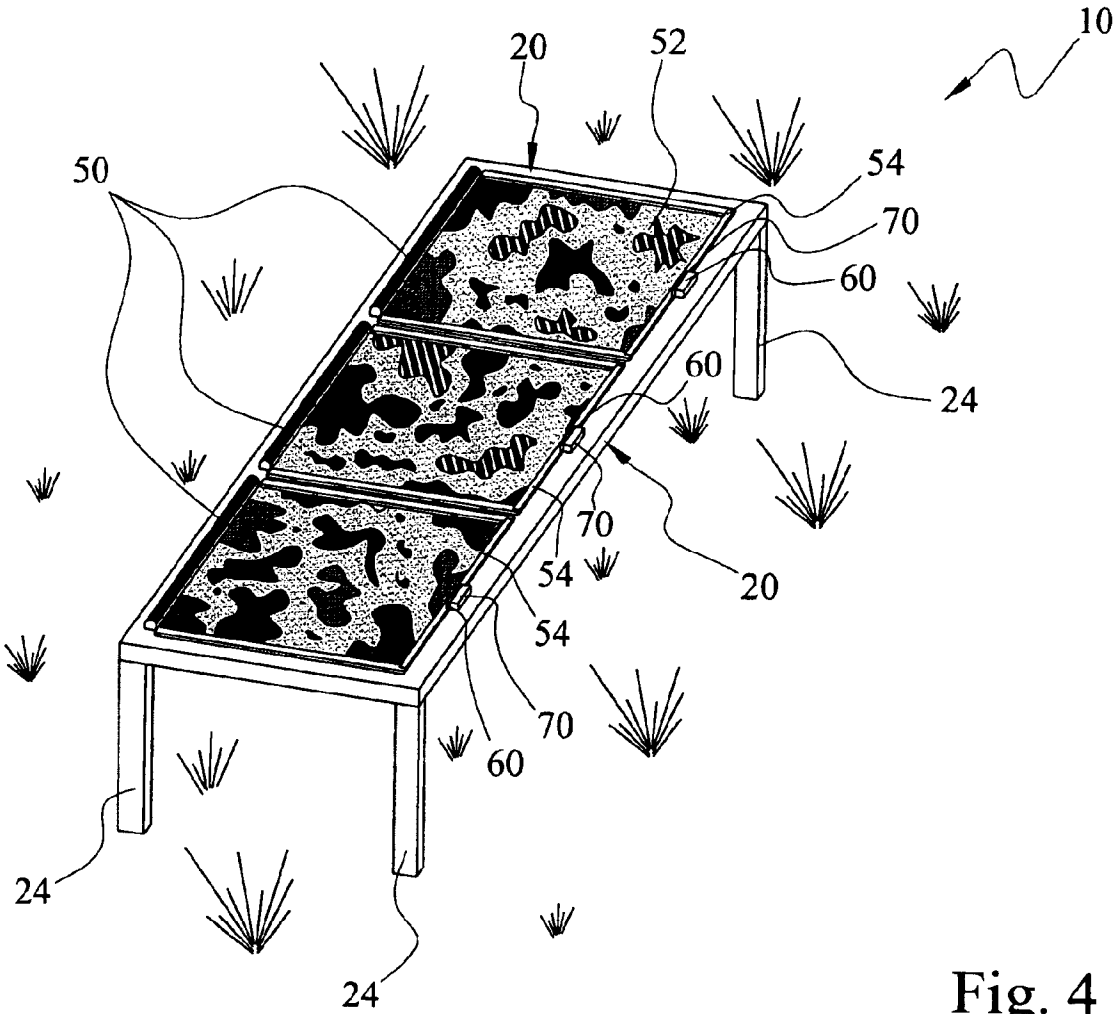
FIG. 4 is an alternative embodiment of the present invention with a support structure.
Figure 5:
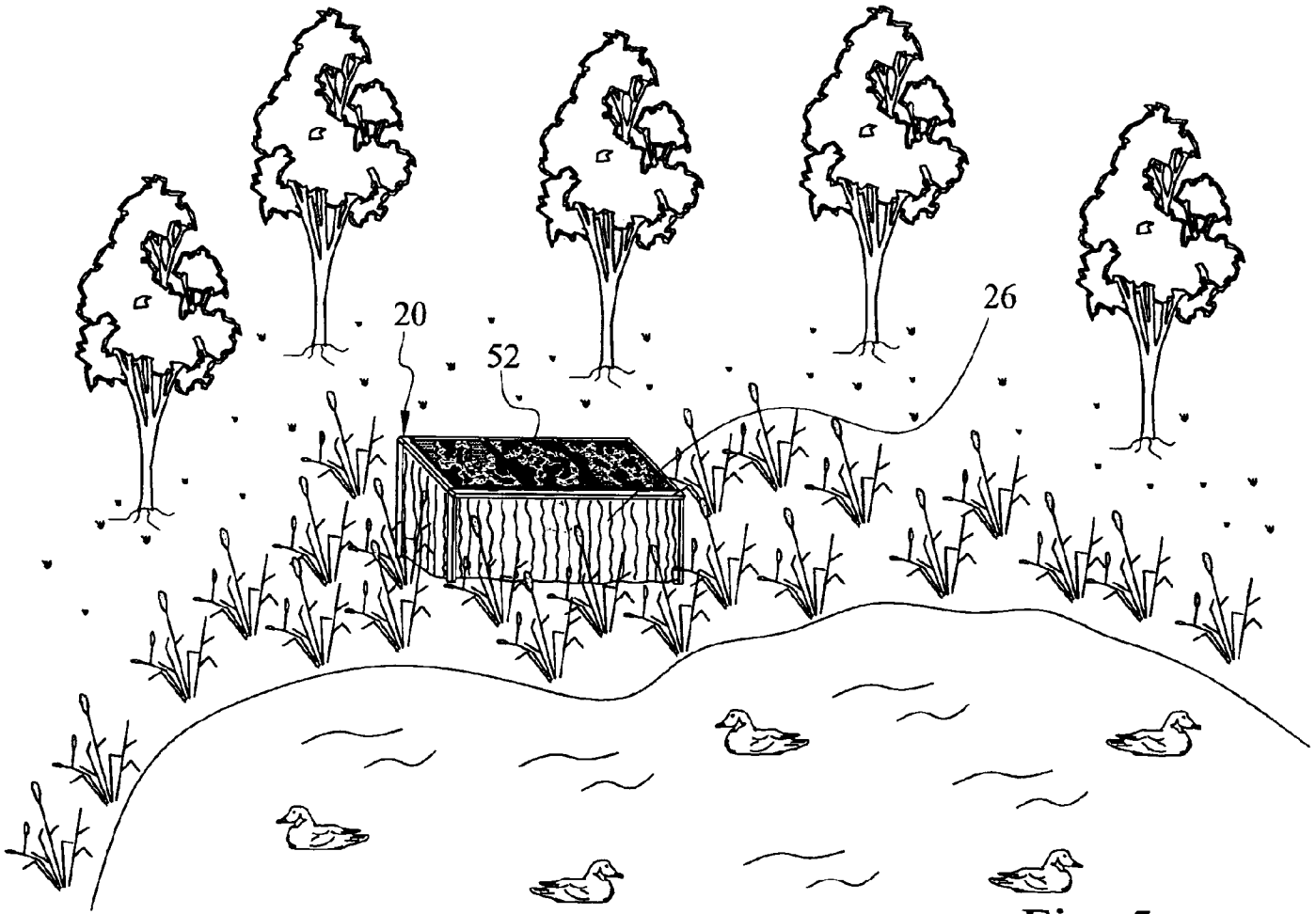
FIG. 5 is an upper perspective view of the alternative embodiment of the present invention with side camouflage.

The frame structure 20 is preferably comprised of a relatively straight and flat structure as shown in FIGS. 1 through 4 of the drawings. However, the frame structure 20 may include a support structure 24 for elevating the frame structure 20 as shown in FIG. 4 of the drawings. The support structure 24 is preferably comprised of a plurality of leg units or the like. A length of side camouflage 26 may extended from the frame structure 20 about the sides of the support structure 24 for further concealing the hunter as shown in FIGS. 5 and 6 of the drawings.

A recoil unit 50 is attached at an end of each of the openings 22 as best illustrated in FIGS. 2 through 3 of the drawings. Each recoil unit 50 receives and dispenses the camouflage sheet 52 in a biased manner. The recoil unit 50 may be comprised of any conventional structure capable of applying a rotational force to a shaft receiving the camouflage sheet 52.

The camouflage sheet 52 has a desired camouflage design as shown in FIGS. 1 through 4 of the drawings. Each camouflage sheet 52 may be different or the same. In addition, the camouflage sheet 52 may be replaced with a different camouflage sheet 52 to correspond to the camouflage requirements of the hunter and surroundings. The camouflage sheet 52 may be comprised of various materials commonly utilized within the camouflage industry. The camouflage sheet 52 is preferably see through from the inside to allow the hunter to view the wild game outside.

An elongate handle member 54 is attached to a distal end of the camouflage sheet 52. The opposing ends of the elongate handle is preferably slidably received within a first rail 30 and a second rail 40 as shown in FIGS. 1 through 4 of the drawings. The first rail 30 and the second rail 40 are attached to the opposing sides of each of the openings 22 as best illustrated in FIG. 1 of the drawings. The first rail 30 and the second rail 40 may be comprised of various rail structures having a slot for receiving the distal ends of the handle member 54.

A first connector 60 is attached to each handle member 54 as further shown in FIGS. 1 through 4 of the drawings. A corresponding second connector 70 is attached to an end of each of the openings 22 opposite of the recoil unit 50 as best illustrated in FIG. 1 of the drawings. The first connector 60 and the second connector 70 are removably mateable with one another for allowing securing and releasing of the camouflage sheet 52 within an extended and retracted position about each of the openings 22. The first connector 60 and the second connector 70 may be comprised of various connection devices such as magnets, clips, latches, hooks, hook and loop structures, and the like.

In use, the user transports and positions the frame structure 20 in the desired position about a goose pit 12 or other structure. The user then pulls upon each handle member 54 thereby drawing the camouflage sheet 52 out of the recoil unit 50 until the first connector 60 is secured to the second connector 70. The hunter then waits for the wild game to approach their position and then manipulates the handle member 54 thereby causing the release of the first connector 60 from the second connector 70. The recoil unit 50 automatically draws the camouflage sheet 52 back into the recoil unit 50 in a spring manner thereby removing the camouflage sheet 52 from the corresponding opening 22. This process is repeated until the hunter is finished with their hunter after which they may simply transport the hunter concealment system 10 to a new location or to their vehicle.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of operating a hunter concealment apparatus, said hunter concealment apparatus comprising a substantially flat frame structure having a plurality of openings therein, a plurality of biased recoil units, each attached to a first end of one of said openings, and a plurality of camouflage sheets, each connected to one of said biased recoil units, said method comprising the steps of:

(a) positioning said hunter concealment apparatus over a desired location such that a person can be positioned under said concealment apparatus;

(b) extending at least one of said camouflage sheets over one of the corresponding openings such that the person is at least partially concealed from view, wherein each said camouflage sheet is adapted to allow the person to see through said camouflage sheet to view objects positioned on an opposing side of said camouflage sheet; and (c) automatically recoiling said camouflage sheet utilizing said biased recoil unit to provide the person access to the corresponding opening.

2. A method of concealing a hunter, said method comprising:

positioning a hunter concealment frame structure that includes at least one hunter access opening over a hunter reposing location;

extending a camouflage sheet in a biased manner to cover the hunter access opening, wherein the camouflage sheet is adapted to substantially conceal the hunter positioned in the hunter reposing location from view while simultaneously allowing the hunter to see through the camouflage sheet, thereby allowing the hunter to view prey on an opposing side of said camouflage sheet without the prey being able to view the hunter; and automatically recoiling the camouflage sheet in a spring manner utilizing a biased recoil unit to allow the hunter access to the hunter access opening, wherein the camouflage sheet is connected to the biased recoil unit and the biased recoil unit is connected to the frame structure at one end of the hunter access opening.

3. The method of claim 2, wherein positioning the hunter concealment frame structure over a hunter reposing location comprises positioning the hunter concealment frame structure over a pit.

4. The method of claim 2, wherein extending the camouflage sheet comprises extending a plurality of camouflage sheets to cover a plurality of the hunter access openings within the hunter concealment frame structure to substantially conceal from view a plurality of hunters positioned in the hunter reposing location while simultaneously allowing each hunter to see through the camouflage sheets.

5. The method of claim 2, wherein the method further comprises:

replacing the camouflage sheet with a different camouflage sheet to correspond the surroundings of the hunter.

* * * * *